US005294098A

United States Patent [19]

Bundy

[11] Patent Number: 5,294,098

[45] Date of Patent: Mar. 15, 1994

[54] APPARATUS FOR MOUNTING A CAR DOOR

[76] Inventor: Douglas M. Bundy, P.O. Box 56, Naubinway, Mich. 49762

[21] Appl. No.: 930,084

[22] Filed: Aug. 12, 1992

[51] Int. Cl.[5] ..... B66F 3/00

[52] U.S. Cl. ..... 269/17; 269/285; 269/296; 254/8 B; 254/134

[58] Field of Search ..... 254/133, 134, 8 B; 269/17, 296, 285

[56] References Cited

U.S. PATENT DOCUMENTS 2,903,258 9/1959 Jovanovich ..... 254/134
2,908,403 10/1959 Browder et al. ..... 269/17
3,030,103 4/1962 Allen et al. ..... 269/17
3,892,385 7/1975 Andrist ..... 254/133 R
4,269,394 5/1981 Gray ..... 254/134

*Primary Examiner*—Robert C. Watson
*Attorney, Agent, or Firm*—Weintraub, DuRoss & Brady

[57] ABSTRACT

An apparatus for mounting a car door by a single mechanic is provided. The apparatus supports a car door to be mounted on a vehicle on a base. Arms connected to the base support the door upon the base. The apparatus is mounted upon a floor jack or an equivalent elevating device to effect chances in vertical orientation of the apparatus. The elements used to mount the apparatus on the elevating device also allow pivoting of the apparatus.

2 Claims, 1 Drawing Sheet

APPARATUS FOR MOUNTING A CAR DOOR

BACKGROUND OF THE INVENTION

1. Field of the Invention

The present invention concerns an apparatus for mounting a car door. Specifically, the apparatus of the present invention concerns apparatus for enabling the mounting of a car door by a single person.

2. Prior Art

In the automobile industry, the hanging of a door on a motor vehicle is a difficult and exacting procedure, whether performed at assembly time or later in a repair facility. The weight of the door requires one person, and often two, to hold the door at the proper height while an additional person affixes the door to the hinges of the vehicle's body. A series of adjustments ensue to properly fit the door within the frame. The adjustments consist in the loosening of the hinges and the movement of the door vertically and/or horizontally. It may even be necessary to remove and remount the door to adjust the portion of the hinges.

This task is tedious, inexact and requires one or two workers to stand idle until physical adjustment is needed. This is both inefficient use of resources and an inefficient method of hanging a door. There is a need for an apparatus to facilitate more exact hanging of a door that does not require two or three workers. It is to this need that the present invention is directed.

SUMMARY OF THE INVENTION

The present invention is an apparatus for hanging a door on a vehicle, the apparatus comprising:

(a) a base on which the door rests;

(b) a plurality of arm mounts fixedly attached to the base;

(c) a plurality of arms attached to the arm mounts; and d) means for mounting the apparatus on means for elevating the apparatus.

The present invention may further comprise the means for elevating. Additionally, the apparatus may further comprise a plurality of door rests affixedly attached to the arm mounts. The door rests cushion the car door when mounted upon the apparatus, so that the door is not scratched during the hanging process. Also, means for releasably attaching the arms to the arm mounts may be included.

Also, the apparatus of the present invention may further comprise means for increasing the height of the apparatus, such that the apparatus will accommodate longer doors therein. The arms of the apparatus may have disposed thereon a resilient cushioning layer disposed therearound.

The present invention will be more clearly detailed with reference to the following drawings, in which like reference numerals refer to like elements.

DETAILED DESCRIPTION OF THE PREFERRED EMBODIMENT

Figure 1:
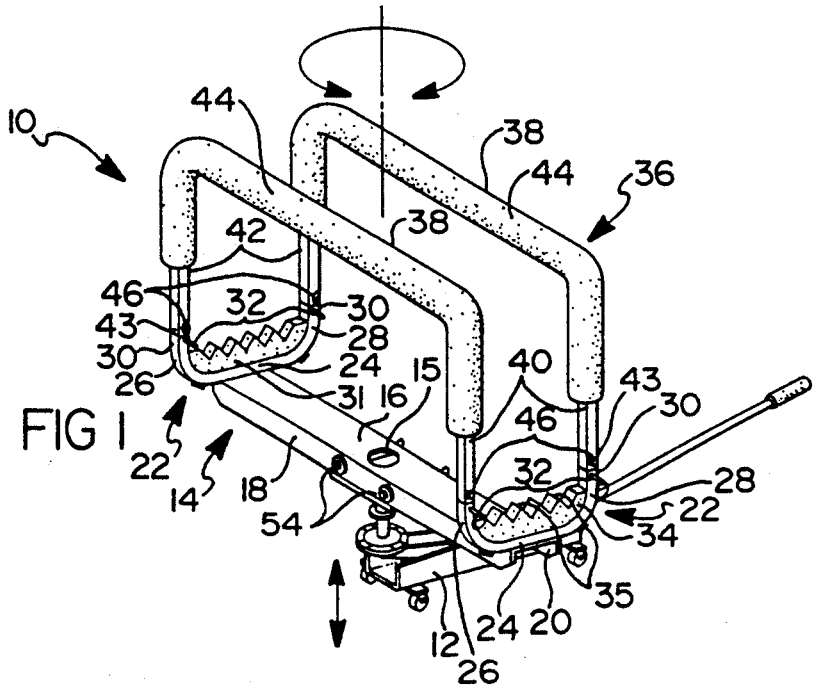
FIG. 1 is a perspective view of the door mounting apparatus of the present invention mounted on a floor jack.

Referring now to FIGS. 1–4, there is shown therein the preferred embodiment of the present invention, to wit, an apparatus 10 for hanging a door 45 on a vehicle (not shown). As seen in FIG. 1, the apparatus 10 is mountable upon means 12 for elevating the apparatus, such as a conventional floor jack 13, of the type well known to the skilled artisan. Other means for elevating may be used, such as a hydraulic lift or the like. The critical requirement of the means for elevating is to effect change in the vertical elevation and optimally the horizontal orientation of the apparatus 10, as well. This will facilitate movement of the apparatus 10 toward the chassis of the automobile, as well as to direct the proximity of the door to the hinges in the door frame of the vehicle.

The apparatus 10 comprises a base 14, a least a pair of spaced apart, substantially parallel arm mounts 22 and 22', and at least a pair of spaced apart, substantially parallel arms 36 and 36', which extend normal and between the mounts 22 and 22'.

The apparatus 10 may further comprise means for releasably attaching each arm to its associated arm mount, as described herein below, means 48 to extend the length of the arms, and means for mounting the apparatus 10 on the means for elevating 12.

The base 14 is formed of a suitable sturdy material, such as steel, rigid plastic or the like, sufficient to withstand the weight of the apparatus and a door. In the preferred embodiment, the base 14 is a U-shaped element, having a flat member or base plate 16 and two opposing sides 18, 20 integral with the flat member 16. The sides 18, 20 extend below and substantially perpendicular to the flat member 16. The base 14 serves as the primary structural support member of the apparatus 10 to bear the weight of a door. The base plate 16 has an aperture 15 formed therein to facilitate access for the means for mounting, as described herein further below.

Each arm mount 22, 22' is a U-shaped member having a bottom portion 24 and side portions 26, 28 formed integrally therewith. The arm mounts 22 are fixedly attached to the flat member 16 of the base 14 by fasteners, welding or other suitable means (not shown). Each side portion 26, 28 has a recess (not shown) centrally formed therein for seating an interconnecting member 48 as described herein below.

As shown in FIG. 1, each side portion 26, 28 has opposing colinear apertures 30 formed therein to allow fasteners 32 to be deployed therethrough, as described further herein below. The arm mounts 22 allow the arms 36 to be detachably mounted to the base 14.

The arm mounts 22 also allow for deployment of a door rest 34 above the bottom portion 24 and between the side portions 26, 28 thereof. The door rests 34 cushion the car door 45 deployed on the apparatus 10. The door rest 34 is formed of a suitably strong and resilient material, such as rubber, rigid foam, or the like. To avoid movement of a door upon the door rest 34, a plurality of saw-tooth ridges 35 may be formed on the upper surface of the door rest 34. The bottom edge of a door would sit in the valley between two ridges 35, the ridges 35 preventing lateral movement of the door.

Figure 3:
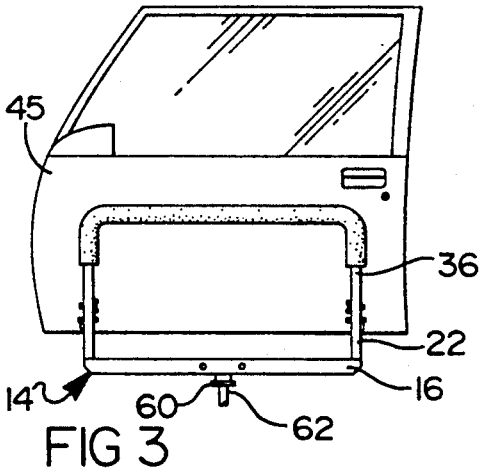
FIG. 3 is a side view of the preferred embodiment of the present invention having a door held therein.

As seen in FIGS. 1 and 3, the arms 36 are U-shape members, comprising a middle portion 38 having formed integrally therewith two side portions 40, 42. The arms 36 are formed of steel or other suitably strong material. A protective layer 44 may be deployed on the arms 36. The layer 44 is formed of a suitably strong yet resilient material, such as foam. The layer 44 is ideally coated around the entirety of the arms 36. The layer 44 acts to prevent scratching of the paint finish on a door 45 deployed on the apparatus 10, as shown in FIG. 3.

The arms 36 are mounted upon the arm mounts 22, such that the side portions 40, 42 of one arm 36 are fitted atop the first side portions 26 of each arm mount 22. Likewise, the second arm 36 is mounted atop the second side portion 28 of each arm mount 22. As shown in FIG. 1, this arrangement deploys the arms 36 essentially parallel to the base 14. The arms 36 and the base 14 are substantially formed to the same length in FIG. 1. The arms 36, however, could be formed to a smaller length with a corresponding adjustment in the location of the arm mounts 22. The arms 36 have pairs of colinear apertures 43 formed in the side portion 40,42 for disposing fasteners therethrough, as described herein further below.

Figure 2:
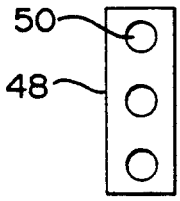
FIG. 2 is a side view of an interconnecting member of the door mounting apparatus of the present invention.

The arms 36 and the arm mounts 22 are releasably joined by a plurality of fasteners 32,46 and an interconnecting member 48. The interconnecting member 48, as shown in FIG. 2, comprises a solid member formed to a size corresponding to the recesses formed in the side portion 26, 28 of the arm mounts 22 and the side portions 40, 42 of the arms 36. The interconnecting member 48 has a plurality of bores 50 formed therethrough. Although the interconnecting member 48 is shown in FIG. 2 as having 3 bores formed therein, it is envisioned that the interconnecting member 48 may have as many as 8 or 10 bores formed in an elongated embodiment of the interconnecting member 48. The bores 50 are aligned with the apertures 30 formed in the arm mounts 22 such that the fastener 32, shown as a ringed bolt, may be deployed through each member 22, 48. Likewise, the apertures 43 of the arms 36 are aligned with another bore 50 of the interconnecting member 48, such that one fastener 46, such as a bolt, can be deployed therethrough. By this interconnection, the arms 36 and the arm mounts 22 are joined together.

It is noted that the interconnecting member 48 can serve to allow for securing the arms 36 above the arm mount 22. This occurs by fastening the arm 36 to the interconnecting member 48 at a higher bore 50. Thus, the apparatus 10 can achieve a greater height, therefore supporting doors of greater height. The interconnecting member 48 thus serves as a means for extending the height of the apparatus 10.

It is noted that, in an alternate embodiment, the arms 36 could be formed to fit within the recesses of the side parts 26,28 of the arm mounts 22. Thus, in this alternate embodiment, the arms 36 have no recesses formed in the side portion 40,42. Rather, the side portions 40,42 are formed to correspond to the recesses of the side portions 26,28 of the arm mounts 22. At least one bore would be formed through the side portions 40,42 of the arms 36 to replace the apertures 43 formed therethrough. Thus a fastener similar to the rigid bolt 32 would pass through the apertures 30 of the arm mount 22 and through the bore of the arms 36 to effect attachment of these members.

Figure 4:
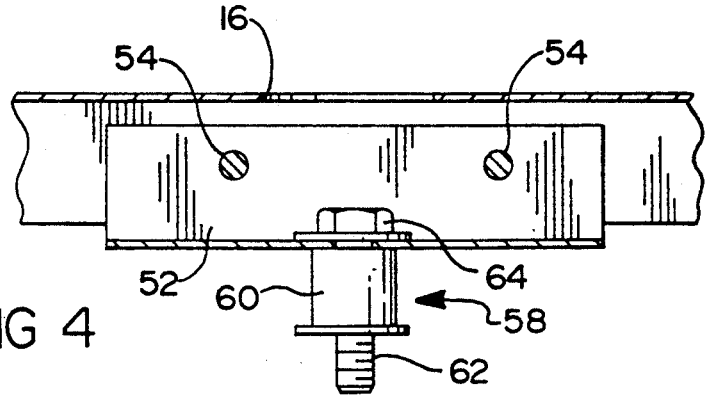
FIG. 4 is a side view of the means for mounting of the door mounting apparatus of the present invention.

Referring specifically to FIG. 4, base 14 and the means for mounting the apparatus 10 to the means for elevating is shown, preferably, as a cross member 52 is fixedly attached to the base 14. The cross member 52 is U-shaped, with the cross member 52 fitting between the opposing sides 18, 20 of the base 14. A plurality of bolts 54 secure the cross member 52 to the base 14 through corresponding apertures formed in each member 52, 14.

The means for mounting comprises a mounting bolt 58 and a tubular member 60. The bolt 58 comprises a stem 62 and a head 64. The head 64 rests upon the cross member 52, the stem 62 extending through and aperture in the cross member 52. The tubular member 60 is deployed axially around the stem 62 of the mounting bolt 58. The tubular member 60 facilitates a secure fit with the floor jack 12, which normally has a corresponding aperture (not shown) to receive the member 60. If the jack 12 has no apertures, equivalent means to these, as are known in the art, may be employed to secure the apparatus 10 to the floor jack 12. The mounting bolt 58 may be accessed, if needed, throught the aperture 15 of the base 14.

The operation of the present invention will now be described. The technician or mechanic mounts the apparatus 10 on a floor jack 12 or other means for elevating, as shown in FIG. 1. The car door 45 is placed upon the door rest 31, above the base 14 and between the arms 36, as shown in FIG. 3. By moving the apparatus 10 and floor jack 12 in the horizontal plane, that is, along the floor, the door 45 can be brought to the car body (not shown) to effect mounting on the hinges. The means for elevating are then used to raise the door 45 to a proper height. This operation is accomplished by only one mechanic. If adjustment is required, the hinges are simply loosened and the vertical height altered by the floor jack 12 or horizontal orientation by movement of the apparatus 10. Once properly mounted, the apparatus 10 may be lowered by the jack 12 and withdrawn from the vehicle.

Having, thus, described the invention, what is claimed is:

1. An apparatus for hanging a door on a vehicle, the apparatus comprising:

(a) a base;

(b) a plurality of arm mounts fixedly attached to the base, each arm mount comprising a U-shaped member having two side parts and a bottom part formed integrally together, each side part having a recess formed therein;

(c) a plurality of arms attached to the mounts;

(d) means for releasably attaching the arms to the arm mounts, the means for releasably attaching comprising:

(1) a plurality of interconnecting members having a plurality of bores formed therethrough; and (2) a plurality of fasteners;

wherein one end of the interconnecting members are received within the side parts of the arm mounts, each interconnecting member being secured by one fastener being deployed through one arm mount and one bore of the interconnecting member and by a second fastener being deployed through one arm and a second bore of the interconnecting member;

(e) a cross member fixedly attached to the base, the cross member having a central aperture formed therein;

(f) a bolt having a head and a stem, the bolt being deployed through the central aperture and the head resting against the cross member;

(g) a plurality of door rests formed of a strong resilient material and having a plurality of saw tooth ridges formed thereon being deployed on the arm mounts, and (h) means for elevating the apparatus.

2. The apparatus of claim 1, wherein the interconnecting member functions to act as means for extending the arm length.

* * * * *